United States Patent [19]

Bourlet

[11] 4,312,263

[45] Jan. 26, 1982

[54] PISTOL

[75] Inventor: Maurice V. Bourlet, Liege, Belgium

[73] Assignee: Fabrique Nationale Herstal, en abrege F.N., Herstal, Belgium

[21] Appl. No.: 100,259

[22] Filed: Dec. 4, 1979

[30] Foreign Application Priority Data

Jan. 10, 1979 [BE] Belgium ..... 57535
May 21, 1979 [BE] Belgium ..... 57809

[51] Int. Cl.[3] ..... F41D 11/02
[52] U.S. Cl. ..... 89/154; 42/70 F
[58] Field of Search ..... 42/69 B, 70 D, 70 F; 89/132, 150, 151, 154

[56] References Cited

U.S. PATENT DOCUMENTS 584,631 6/1897 Fosberg ..... 89/154
1,618,510 2/1927 Browning ..... 89/154

*Primary Examiner*—Stephen C. Bentley
*Attorney, Agent, or Firm*—Bacon & Thomas

[57] ABSTRACT

Improved pistol of the type comprising a body carrying a moving slideway supporting a barrel and a firing-pin, the device actuating the said firing-pin consisting of a kinematic chain comprising a detent pivoting on the body, levers driving a sear and a hammer pivoting on the body, said hammer being subjected to the action of a spring and controlled by the sear, characterized in that the hammer is mounted coaxially with at least one ring having two stops for the hammer, the ring having a notch engageable by the said sear.

6 Claims, 5 Drawing Figures

PISTOL

BACKGROUND OF THE INVENTION

The present invention relates to an improved pistol.

The term "pistol" means a pistol proper, i.e. a weapon loaded through a loader incorporated into the handle, or a revolver, namely a drum-loaded weapon.

Generally, the pistols may be subdivided into two groups according to whether they are of the single-action or the double-action type.

The single-action weapons require the manual cocking of the hammer previous to the shooting released by pressure on the detent. On the contrary, in the double-action weapons, a first stroke of the detent provides said cocking (for the first cartridge), whereas the end of the detent stroke causes percussion. The major drawback of the double-action weapons lies in the fact that the pressure being exerted onto the detent when shooting the first time is relatively high so that the accuracy of the shooting is problematical.

SUMMARY OF THE INVENTION

The purpose of the present invention is to avoid said drawback.

This object is obtained according to the invention through an improved pistol, e.g. of the type comprising a body carrying a moving slideway supporting a barrel and a firing-pin, the device actuating the said firing-pin consisting of a kinematic chain comprising a detent pivoting on the body, levers driving a sear and a hammer pivoting on the body, said hammer being subjected to the action of a spring and controlled through the said sear, characterized in that the said hammer is mounted coaxially with at least a ring having two stops for the latter, and a notch engageable by the said sear.

BRIEF DESCRIPTION OF THE DRAWINGS

For more clearness, an embodiment of a pistol according to the invention will be described hereafter by way of illustration and without any limitation, reference being made to the enclosed drawings in which.

DESCRIPTION OF THE PREFERRED EMBODIMENTS

Figure 1:
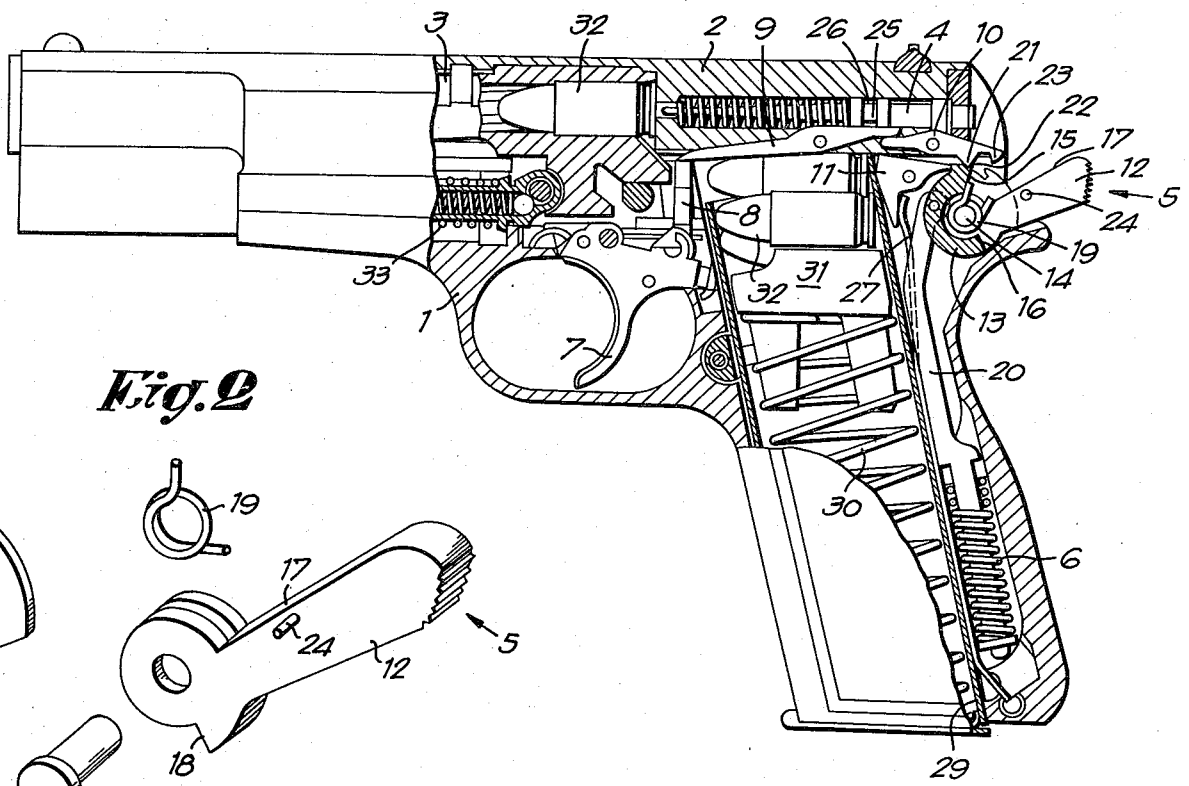
FIG. 1 is a side view partially in section of a pistol according to the invention.
Figure 2:
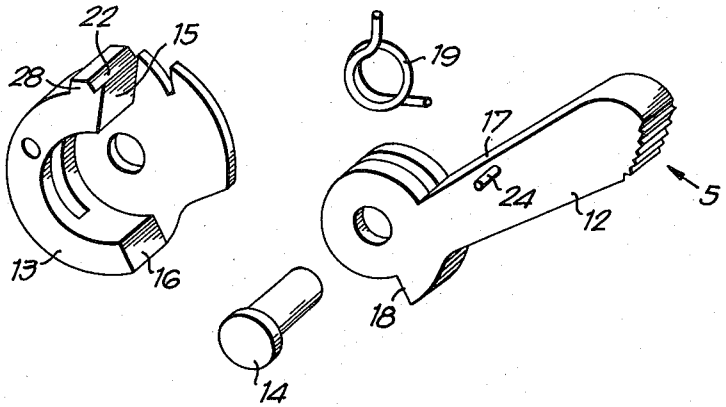
FIG. 2 is a perspective exploded view of the hammer of the weapon illustrated in FIG. 1.

The pistol as shown comprises a body 1 carrying a moving slideway 2, the latter supporting a barrel 3 as well as a firing-pin 4.

A hammer 5 pivoting on the body 1 is allowed to hit the said firing-pin 4 under the action of a spring 6 through the intermediary of a kinematic chain comprising a trigger 7, a trigger-lever 8, a trigger-lever 9, a catching lever 10 (the two latter levers pivoting on the slideway 2) and a sear 11.

The construction of the hammer 5 is particular and forms the essential characteristic of the invention. In fact, said construction comprises a hammer proper 12 mounted coaxially with a ring 13 on an axis 14.

The said ring 13 has two stops, 15 and 16 respectively, for a front side 17 and a tooth 18 of the hammer 12. A spring 19 pushes the hammer 12 towards a position in which its tooth 18 contacts the said stop 16.

One end of a tail 20 actuated by the said spring 6 is engaged with the ring 13.

The catching lever 10 has a tooth 21 arranged to engage a notch 22 of the ring 13, as well as a nose 23 which may catch a finger 24 provided on the hammer 12.

A side safety finger 25 for the sear-lever 9 penetrates a groove 26 of the firing-pin when the weapon is in the position shown in FIG. 1.

The sear 11 is pushed as known towards its lower position by a spring 27, a position in which it engages a stop 28 of the ring 13.

FIG. 1 shows a loader 29 comprising a spring 30 driving a carrier 31 as well as the ammunition 32.

The assembly consisting of the slideway 2 and the barrel 3 is pushed forwardly by a recoil spring 33.

The above described pistol functions substantially as described hereafter.

After having introduced the loader 29 into the grip, an ammunition 32 is fed into the chamber of the barrel 3 by manually actuating the slideway 2 which cocks the hammer 12 while tightening the spring 6.

Should the weapon be transported in that state, it is then possible to bring the hammer 12 forwardly by pushing it back manually against the action of the spring 19 until the nose 23 of the lever 10 catches the finger 24 of the hammer 12.

In that position, the tooth 21 forms a brake for a possible recoil movement of the slideway owing to an accidental shock, friction of the weapon when it is introduced into a case, and the like . . .

The so prepared weapon is ready for shooting. A first movement of the trigger 7 raises the catching lever 10, the nose 23 releases the finger 24 of the hammer 12 which, under the action of the spring 19, takes the position shown in FIG. 1.

By extending said first movement of the trigger 7, the front end of the lever 10 bears on the nose of the sear 11 thereby releasing the ring 13.

Under the action of the spring 6, said ring pivots suddenly, thereby driving the hammer 12 against the firing-pin 4.

Owing to the departure of the shot, the slideway 2 is pushed backwards, thereby driving back the hammer 12 which carries the ring 13 while tightening the spring 6.

The slideway 2 brought back forwardly through the spring 33 feeds new ammunition 32 into the chamber.

The hammer 12 remains in the position indicated in FIG. 1.

Thereby, the weapon is ready for shooting again.

When the weapon must be transported in that state, it is possible and even preferable to bring back the hammer 12 forwardly.

It is seen that, owing to these arrangements, the trigger 7 is never used for tightening the spring 6, thereby avoiding the drawback of the double-action weapons.

Figure 3:
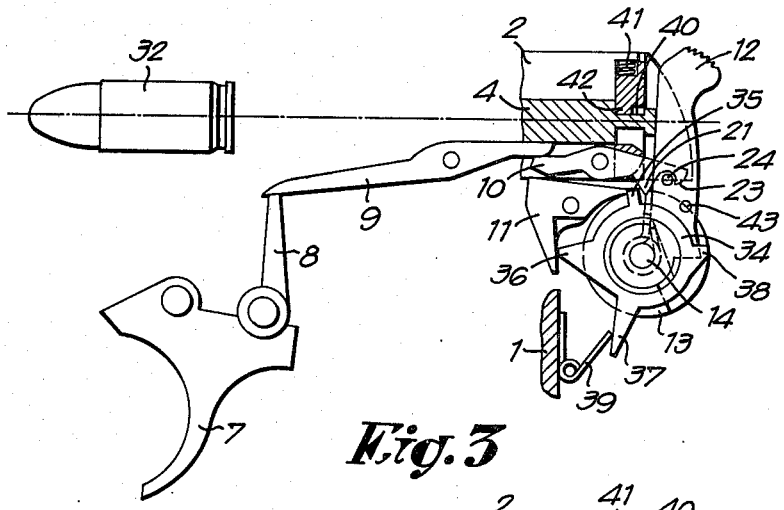
FIG. 3 shows a modified embodiment of the weapon hammer in a safety position.
Figure 4:
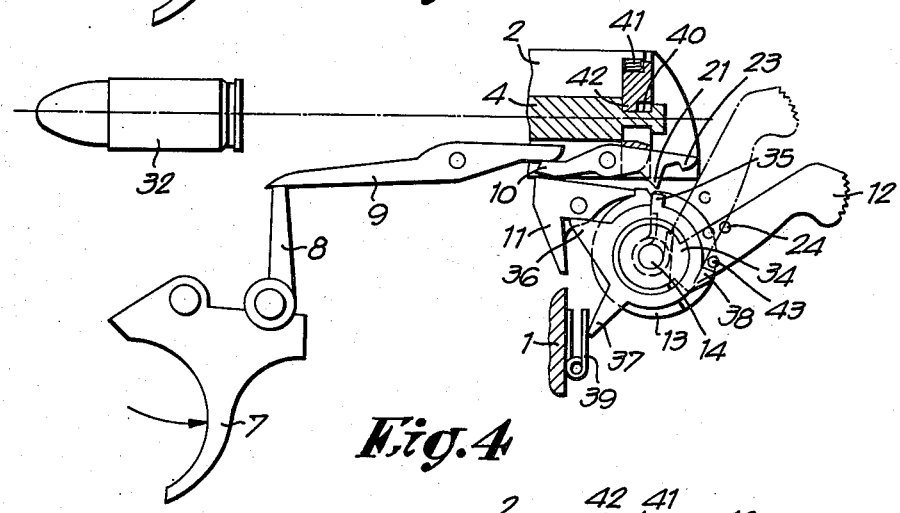
FIG. 4 shows the hammer of FIG. 3 in cocked position.
Figure 5:
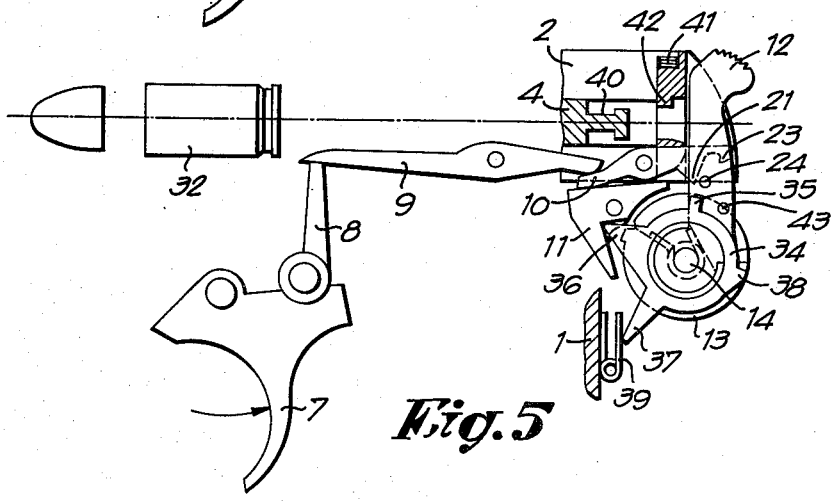
FIG. 5 shows the hammer of FIG. 3 at the departure of the shot.

In a modified embodiment as shown in FIGS. 3 to 5, the hammer 12 is mounted coaxially with the first ring 13 and with a second ring 34 on the axis 14.

The second ring 34 has four stops 35, 36, 37 and 38.

In the safety position (FIG. 3), the first stop 35 bears against the back portion of the sear 11 under the influence of a spring 39 bearing, on one hand, against the body 1 of the weapon and, on the other hand, against the stop 37 of the ring 34. In this position of the ring 34, the stop 36 bears against the sear 11, thereby preventing any movement.

It will be seen that, in this modified embodiment, the firing-pin 4 has, at its back portion, a groove 40 penetrated by a safety finger 42 under the influence of a spring 41.

A first movement of the trigger 7 (FIG. 4) raises the catching lever 10, whereas the nose 23 releases the finger 24 of the hammer 12 which takes the position shown in FIG. 4 under the action of the spring 19. During this movement, a second finger 43 provided on the hammer 12 bears against the stop 38, thereby pushing the ring 34 against the action of the spring 39. The stops 35 and 36 no longer engage the sear 11, thereby releasing it.

By extending said first movement of the trigger 7, the front end of the lever 10 bears against the nose of the sear 11 which releases the ring 13 (FIG. 5). Namely, the safety finger 42 is driven back from the groove 40 of the firing-pin 4 through the movement of the back portion of the catching lever 10.

Under the action of the spring 6, the ring 13 pivots suddenly, thereby carrying the hammer 12 against the firing-pin 4, which causes the departure of the shot.

Under the influence of the explosion, the slideway 2 is driven backwards and, during its movement, it carries the hammer 12 and accordingly also the ring 13 into its cocking position, while tightening again the spring 6.

As soon as the hammer 12 has left its cocked position as shown in FIG. 4, under the action of the spring 39, the ring 34 tends to take again the position shown in FIG. 3. The ring 34 takes this position as soon as the trigger 11 comes backs into the position shown in FIG. 3.

The ring 34, which locks the sear 11 when the hammer 12 is not in the cocked position shown in FIG. 4, forms an automatic safety system for the sear.

The slideway 2 brought back forwardly through the action of the spring 33 feeds a new ammunition 32 into the chamber. The hammer 12 remains in the position shown in FIG. 4. The weapon is thereby ready for shooting again.

It is apparent that the particular construction of the hammer 5 may be also applied to revolvers and that numerous modifications may be made to the abovedescribed weapon without departing from the scope of the invention.

I claim:

1. Improved pistol of the type comprising a body carrying a moving slideway supporting a barrel and a firing-pin, the device actuating the said firing-pin consisting of a kinematic chain comprising a detent pivoting on the body, levers driving a sear and a hammer pivoting on the body, said hammer being subjected to the action of a spring and controlled by the said sear, characterized in that the said hammer is mounted coaxially with at least one ring having two stops for said hammer, said ring having a notch engageable by the said sear.

2. Pistol according to claim 1, characterized in that, between the said sear-lever and the said sear, is interposed a catching lever pivoting on the said slideway, said catching lever having a nose arrange to engage a lug carried by the said hammer when the latter is driven back manually to the front portion of the weapon.

3. Pistol according to claim 1, characterized in that a spring is interposed between the hammer and the said ring, said spring pushing the hammer to its cocked pistol.

4. Pistol according to claim 1, characterized in that the said hammer is mounted coaxially with a ring having two stops for said hammer, said ring having a notch engageable by the said sear, and with a second ring having a stop locking the sear when the weapon is in its safety position.

5. Pistol according to claim 4, characterized in that the hammer has a second finger arranged to cause pivoting the said second ring.

6. Pistol according to claim 4, characterized in that the second ring is permanently subjected to the action of a spring bearing, on one hand, against the body of the weapon and, on the other hand, against a stop of the said second ring.

* * * * *